United States Patent [19]

Watanabe et al.

[11] Patent Number: 4,949,881

[45] Date of Patent: Aug. 21, 1990

[54] PORTABLE GUN-TYPE ADHESIVE DISCHARGER

[75] Inventors: Kazuhiko Watanabe, Tokyo; Tomoya Onodera, Kanazawa, both of Japan

[73] Assignee: Ryobi Ltd., Hiroshima, Japan

[21] Appl. No.: 363,402

[22] Filed: Jun. 5, 1989

Related U.S. Application Data

[63] Continuation of Ser. No. 165,466, Mar. 8, 1988, abandoned.

[30] Foreign Application Priority Data

Mar. 12, 1987 [JP] Japan ..... 62-36906[U]
Mar. 12, 1987 [JP] Japan ..... 62-36907[U]
Mar. 12, 1987 [JP] Japan ..... 62-36908[U]

[51] Int. Cl.[5] ..... B67D 5/62

[52] U.S. Cl. ..... 222/113; 222/146.2; 126/401; 431/254

[58] Field of Search ..... 222/146.1–146.5; 156/497, 499

[56] References Cited

U.S. PATENT DOCUMENTS

| | | | |
|---|---|---|---|
| 2,997,869 | 8/1961 | Weiss | 126/401 X |
| 3,261,390 | 7/1966 | Saito et al. | 222/146.2 X |
| 4,248,208 | 2/1981 | Diederich | 126/409 |
| 4,262,820 | 4/1981 | Flint | 222/146.2 |
| 4,382,448 | 5/1983 | Tittert | 126/409 X |
| 4,502,465 | 3/1985 | Yoshinaga et al. | 126/409 |
| 4,535,916 | 8/1985 | Mächerle et al. | 126/414 X |
| 4,631,024 | 12/1986 | Shibata et al. | 126/409 X |
| 4,642,158 | 2/1987 | Steinel et al. | 222/146.2 |
| 4,699,123 | 10/1987 | Zaborowski | 126/409 |
| 4,755,073 | 7/1988 | Girardin et al. | 126/401 X |

FOREIGN PATENT DOCUMENTS

| | | | |
|---|---|---|---|
| 123259 | 10/1984 | European Pat. Off. | 222/113 |
| 55-34199 | 3/1980 | Japan . | |
| 2156440 | 10/1985 | United Kingdom | 222/113 |

*Primary Examiner*—Joseph J. Rolla
*Assistant Examiner*—Steven Reiss
*Attorney, Agent, or Firm*—Oliff & Berridge

[57] ABSTRACT

A portable gun-type adhesive discharger operable independent of an external power source. The adhesive discharger includes a main case body for supporting a rigid adhesive stick extending in a longitudinal direction, a hand grip portion for manually holding the main case body, a heating unit disposed in the main case body for melting the adhesive stick, a nozzle portion connected to a front end of the main case body for discharging melted adhesive stick, and a trigger portion disposed at the hand grip portion and connected to the adhesive stick for feeding the adhesive stick toward the nozzle portion. The main case body and the hand grip portion provide an interior space in combination. A gas supply unit having a gas reservoir is provided in the interior space, and catalytically combustible gas is filled in the reservoir. The heating unit includes a catalytic combustion unit disposed in the interior at a position adjacent the adhesive stick. An ignition unit is provided in the interior for igniting the combustible substance fed to the catalytic combustion unit from the gas supply unit.

18 Claims, 6 Drawing Sheets

PORTABLE GUN-TYPE ADHESIVE DISCHARGER

This is a continuation of application Ser. No. 07/165,466 filed Mar. 8, 1988 (now abandoned).

BACKGROUND OF THE INVENTION

The present invention relates to a portable adhesive discharger which is adapted for discharging a thermomelting resin adhesive. More particularly, the present invention relates to a gun-type adhesive discharger in which the adhesive is in a stick shape and is melted by catalytically heating a mixture of fuel gas and air.

In a conventional adhesive discharger, a stick or rod shape solid adhesive previously inserted in a melting pipe has been melted by an electric heater. The melted adhesive has been discharged through a discharging nozzle of the discharger. Such a conventional discharger, however, has required electric power for melting the adhesive so as to supply an electric current to a heating unit, so that use of the discharger has been limited to within an area near a power source. For example, such a conventional discharger cannot be operated if it is used in a storage spot far from the power source, and the like. Such a conventional adhesive discharger is disclosed in Japanese Patent Application Laid-Open publication No. 55-34199.

SUMMARY OF THE INVENTION

It is therefore, an object of the present invention to overcome the above-described prior art disadvantages, and to provide an improved portable gun-type adhesive discharger which is operable without any external power source.

Another object of this invention is to provide such a discharger utilizing catalytic combustion in which a fuel gas contained in the interior of the discharger is subjected to catalytic combustion for generating heat, to thus melt the solid adhesive stick.

Still another object of this invention is to provide such a catalytically combustion type adhesive discharger capable of controlling the amount of combusible gas to be supplied into a catalytic unit for stabilization of catalytic combustion.

Still another object of this invention is to provide such a discharger capable of providing operation timing between the supply and stoppage of the fuel gas and start and suspension of ignition, to thereby prevent the combustible gas from leakage without being ignited.

Still another object of this invention is to provide such a discharger which provides sufficient heat transmission efficiency to the adhesive stick and which provides linear orientation of a discharge stream of the combustion exhaust gas.

Still another object of this invention is to provide such a discharger in which combustion is safe and the discharged adhesive or a surface to be coated with the adhesive is sufficiently heated by the exhaust gas.

These and other objects of the present invention are attained by providing a portable gun-type adhesive discharger which includes a main case body for supporting a rigid adhesive stick extending in longitudinal direction of the main case body, a hand grip portion for holding the main case body, a heating unit disposed in the main case body for melting the adhesive stick, a nozzle portion connected to a front end of the main body for discharging the adhesive stick melted by the heating unit, and a trigger portion disposed at the hand grip portion and connected to the adhesive stick for feeding the same toward the nozzle portion. The main case body and the hand grip portion provide an interior space therein. The improvement of the present invention resides in a combination of a gas supply unit, the heating unit, and an ignition unit. The gas supply unit has a gas reservoir disposed in the hand grip portion for storing catalytically combustible substance (liquidized fuel gas) therein. The heating unit comprises a catalytic combustion unit disposed in the main case body and at a position adjacent the rigid adhesive stick. The ignition unit is adapted for igniting the catalytically combustible substance. The ignition unit is disposed in the interior space. This combination is housed in the space defined by the main case body and the hand grip portion. Therefore, the adhesive discharger according to the present invention is independently operable regardless of an external power source.

DETAILED DESCRIPTION OF THE PREFERRED EMBODIMENTS

Figure 1:
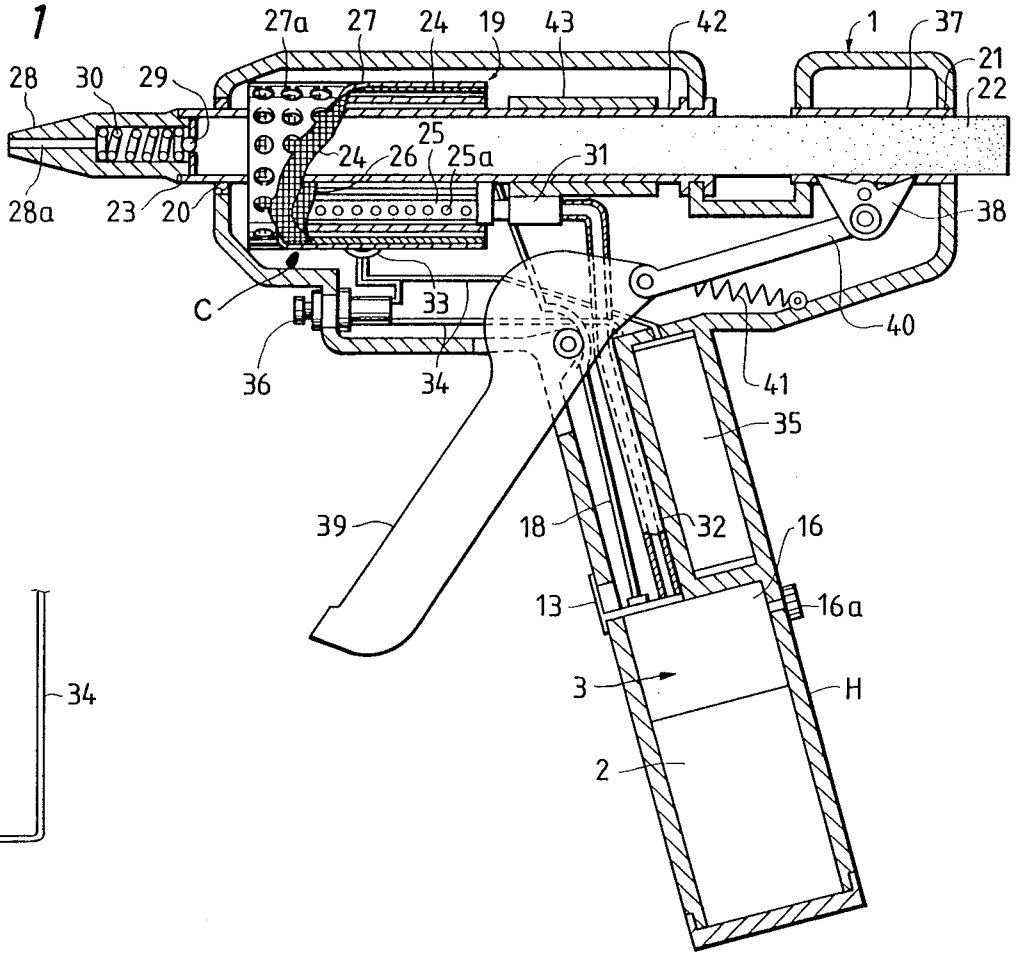
FIG. 1 is a vertical cross-sectional side view showing an overall arrangement of an adhesive discharger according to a first embodiment of this invention.

A first embodiment according to this invention will be described with reference to FIGS. 1 thru 3.

First, the outlines of this discharger will be described. An adhesive discharger includes a main body 1 formed in a gun shape whose lower section has a hand grip portion H which accommodates a gas reservoir 2 filled with fuel gas. A gas flow regulator 3 is disposed at a gas outlet portion of the gas reservoir 2. In the upper section of the main body 1, an adhesive melting means 19 horizontally extends through front and rear end openings 20 and 21 of the main body 1. A thermomelting resin adhesive 22 in a stick shape (hereinafter simply referred to as "adhesive" or "adhesive stick") is set in a heat conductive pipe 23 of the adhesive melting means 19. This means 19 further includes an oxidizing catalytic unit c adjacent to the heat conductive pipe 23. On a front end portion of the heat conductive pipe 23, an injection pipe 25 is mounted in parallel with the heat conductive pipe 23.

The front end of the heat conductive pipe 23 is connected to a discharge nozzle 28 in which a ball valve 29 and a coil spring 30 are provided. The valve 29 is always biased by the spring 30 so as to close a nozzle hole 28*a*.

The above mentioned injection pipe 25 is connected to a mixing pipe 31 which is also connected to the gas flow regulator 3 through a gas conduit 32.

The case body 1 further includes a hollow feeding member 37 for feeding the adhesive stick 22. This feeding member 37 is mechanically connected to a rear end of a trigger pivotably secured on the case body 1 through a clamp arm 38 and a link arm 40. As the trigger 39 is squeezed against the biasing force of a spring 41, the clamp arm 38 clamps the adhesive stick 22 to move it toward the heat conductive pipe 23.

In FIG. 1, reference numeral 42 designates a guide sleeve made of rubber, polytetrafluoroethylene, or the like, and 43 designates a metal tube mounted on the guide tube 42.

The detailed structure and mechanism of each unit of the discharger will next be described.

OXIDIZING CATALYTIC UNIT

Figure 2:
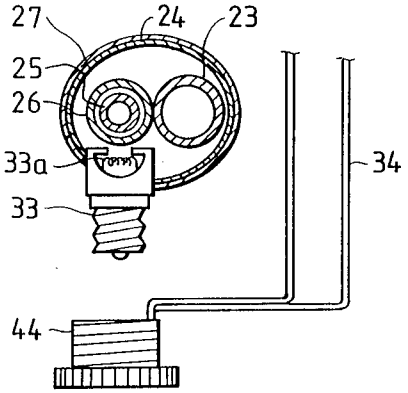
FIG. 2 is a partial cross-sectional elevational view showing an ignition heater used in the first embodiment.

As shown in FIGS. 1 and 2, the oxidizing catalytic unit C includes a first oxidizing catalyst 24 roundly arranged on the heat conductive pipe 23 and a second oxidizing catalyst 26 adjacent to one side of the pipe 23 extending in parallel therewith. The unit C further includes the injection pipe 25 formed with a plurality of injection holes 25*a*. The injection pipe 25 is covered with the second catalyst 26. The first catalyst 24 also covers the injection pipe 25 and the heat conductive pipe 23. Furthermore, the first catalyst 24 is wholly covered with a metal cylinder 27 formed with a plurality of holes 27*a* in order to prevent the first and second catalysts 24 and 26, the injection pipe 25 and the heat conductive pipe 23 from cooling.

The first and second catalyst 24 and 26 comprise material selected from the group consisting of platinum, palladium, rhodium, iron, nickel, chromium, and any equivalent material. The material is preferably provided with properties that it can completely oxidize the mixed gas at a relatively low temperature, and can be subjected a wide temperature range while exhibiting excellent durability.

The first and secon catalysts 24 and 26 are preferably carried by mesh materials. Woven inorganic braid may be used to form te mesh substrate. The inorganic material is selected from the group consisting of rock wool, silica, alumina fiber and glass fiber, etc.

IGNITION UNIT

As shown in FIGS. 1 and 2, an ignition means 33 is disposed beside the injection pipe 25. The ignition means 33 includes a heating member 33*a* in contact with the second oxidizing catalyst 26. The ignition means 33 is electrically connected to a lead wire 34 whose one end is connected to a positive terminal of a battery 35 packed in the hand grip portion of the main body 1 while the other end of the lead wire 34 is connected to the negative terminal via an ignition switch 36. According to this arrangement, the heating member 33*a* is heated when the ignition switch 36 is turned ON.

The reference numeral 44 denotes a socket for receiving the ignition means 33.

GAS SUPPLY UNIT

This invention may employ ordinarily available fuel gas such as butane, propane, LPG, natural gas, urban feeding gas which are gaseous at a normal temperature. As best shown in FIG. 3, a top opening of the gas reservoir 2 of the flow regulator 3 is sealingly fixed with a support member 4 which is formed with a stepped recess 5. A valve member 6 is vertically movably and sealingly arranged in this recess 5 through an O-ring 7 interposed therebetween. A valve seat is defined at a bottom of the recess 5, and a liquidized gas guide member 8 is suspended therefrom and extends into the gas reservoir 2. Further, a gas flow adjusting member 9 is provided between the bottom wall of the valve member 6 and the valve seat. The member 9 is formed of a porous material.

The valve member 6 is formed with a hollow space 6*a*. In the space 6*a*, gas nozzle 10 is arranged movable in its axial direction and is always biased downwardly by a spring 11. A closing member 12 is mounted on the lower end of the gas nozzle 10 and is adapted to close a small hole 6*b* formed in the bottom of the valve member 6. A switch 13 is operably connected to the gas nozzle 10. When the gas nozzle 10 is moved upwardly against the biasing force of the spring 11 by actuating the switch 13, the small hole 6*b* is opened.

According to the above arrangement, a gas conduit 14 is defined between the hollow space 6*a* and the gas nozzle 10. When the small hole 6*b* is opened, the fuel gas (liquid state) in the gas reservoir 2 is supplied to a nozzle opening 10*a* of the gas nozzle 10 through the guide member 8, the gas flow adjusting member 9, and the gas conduit 14. Then, the gas is fed to a nozzle adapter 15 formed with a plurality of air inlet holes 15*a*. The nozzle adapter 15 is connected to the mixing pipe 31 through the gas conduit 32.

Further, a gas flow controller 16 is threadingly mounted on the top section of the gas reservoir 2 so as to threadingly move the controller 16 in the vertical direction along the reservoir 2. The controller 16 is provided with a control lever 16*a* at its side wall and an opening 16*c* formed in the center of its top wall 16*b*. Through the opening 16*c*, the gas nozzle 10 is protruded out of the controller 16. Furthermore, the controller 16 includes a disk-shaped bimetal 17 horizontally interposed between the top wall 16*b* and the support member 4. The circumference of the disk bimetal 17 is supported between the back surface of the top wall 16*b* and an annular sleeve 4*a* extending upwardly from the support member 4. The disk bimetal 17 is also formed with a center opening engageable with the upper end of the valve member 6.

The disk bimetal 17 is connected to a thermoconductive pipe 18 which transmits thermal change of the heat conductive pipe 23 to the gas supply unit. According to this construction, the disk bimetal 17 is thermally deformed downwardly as represented by a phantom line in FIG. 3 so as to depress the valve member 6. Then, the valve member 6 also depresses the gas flow adjusting member 9, so that gas flow rate is decreased.

On the other hand, for increasing the gas flow rate, the deformation of the disk bimetal 17 is reduced. More specifically, the control lever 16*a* is moved to rotatingly shift the gas flow controller 16 upwardly. As the controller 16 shifts upwardly, the bimetal 17 is also loosened with respect to the support member 4. The valve member 6 can be further move upwardly, so that the gap space between the botton of the valve member 6 and the gas flow adjusting member 9 is increased. Reversely, for decreasing the gas flow rate the gas flow controller 16 is moved downwardly.

Figure 3:
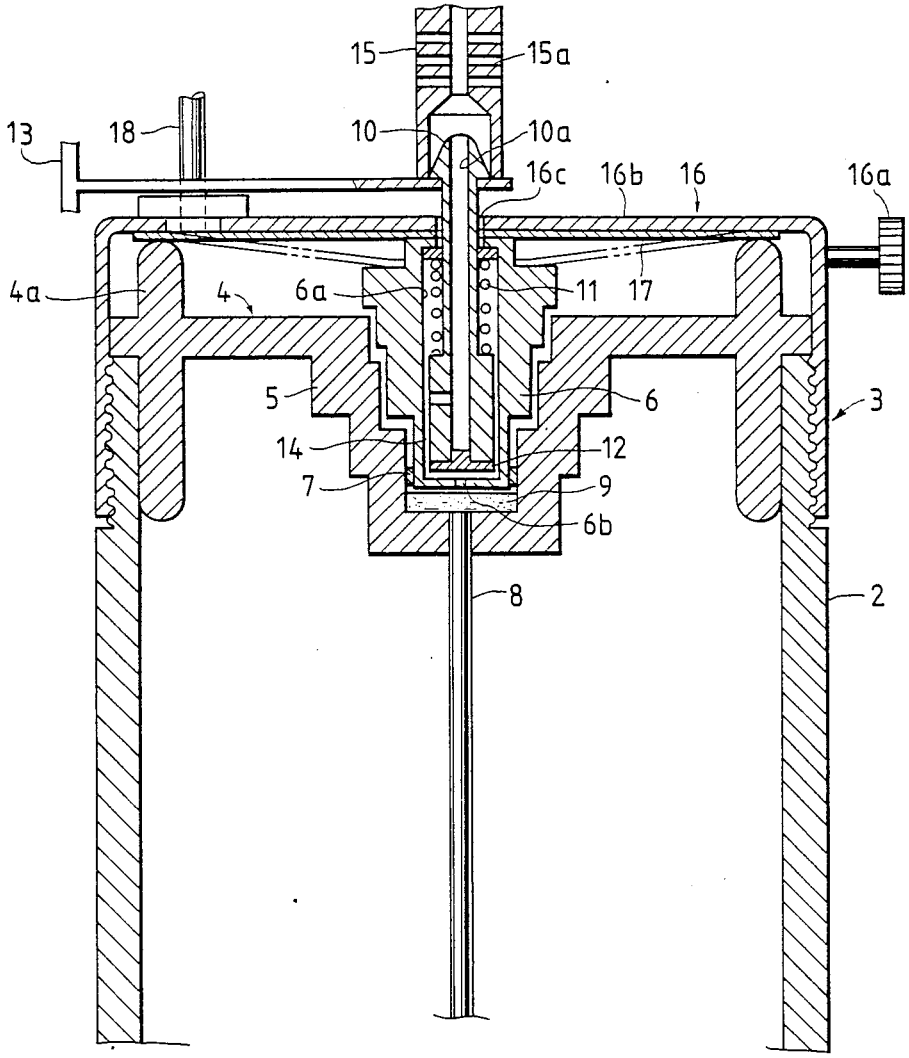
FIG. 3 is an enlarged vertical cross-sectional side view showing a gas flow regulator of the first embodiment.

As the switch 13 is manually pushed upwardly, the gas nozzle 10 is also shifted upwardly to open the gas flow path as shown in FIG. 3. Then, fuel gas is flowed from the reservoir 2 through the small hole 6*b* of the valve member 6 and the gas conduit 14, and is injected into the nozzle adaptor 15 from the nozzle opening 10*a*. In the adaptor 15, the fuel gas is mixed with a primary inlet air introduced through the inlet holes 15*a*. The air/fuel gas mixture is injected into the mixing pipe 31 through the gas conduit 32. In this mixing pipe 31, the injected gas is mixed with secondary air introduced through inlet openings formed in the mixing pipe 31 (not shown). The air/fuel mixture is fed to the injection pipe 25, and is dispersed to the first and second catalysts 24 and 26. The ignition switch 36 is then turned ON to energize the heating member 33*a* of the ignition means 33. The dispersed fuel gas starts catalytic combustion when the heating member 33*a* reaches the predetermined temperature. At the temperature ranging from about 170° C. to about 210° C., the adhesive stick 22 previously inserted in the heat conductive pipe 23 starts melting, and the succeeding adhesive stick 22 newly inserted into the feeding member 37 is then fed into the heat conductive pipe 23 by the feeding motion of the clamp arem 38 which is actuated by the trigger 39. The melted adhesive in the pipe 23 is discharged from the discharge nozzle 28.

When the trigger 39 is free from squeezing, the clamp arm 38 is moved away from the adhesive stick 22 by the biasing force of the spring 41 and the feeding member 37 returns to its original position.

When the temperature of the heat conductive pipe 23 exceeds the predetermined melting point of the adhesive stick 22 due to the influence of combustion temperature and conduction heat, the elevated temperature is transmitted to the bimetal 17 through the thermo-conductive pipe 18. The bimetal 17 is thermally deformed and depresses the valve member 6 downwardly. The gas flow adjusting member 9 under the valve member 6 is compressed, so that its pores are collapsed to thereby lower the flow rate. As a result, the combustion temperature is lowered to the predetermined level, since the combustion temperature depends on the gas flow rate.

On the contrary, when the combustion temperature does not reach the predetermined level, the valve member 6 is shifted upwardly by the biasing force of the spring 11 because of the small deformation of the bimetal 17. The gas flow adjusting member 9 is free from the compressing force and is restored to its original shape, to thus restore its pores or voids. Thus, the gas flow rate is increased and the combustion temperature is elevated to the predetermined level. The above controlled operation is repeatedly performed for stabilizing the combustion temperature.

A second embodiment of this invention will be described with reference to FIGS. 4 thru 7, wherein like parts and components are designated by the same reference numerals and characters as those shown in FIGS. 1 thru 3.

Particular improvements are made on an ignition unit and a gas supply unit in the second embodiment. The gas reservoir 2 has its upper opening provided with a regulator mechanism 54 whose operation is controlled by a cam switch 53. Further, a piezoelectric ignition unit 55 is disposed above the regulator 54 which is actuated by the cam switch 53.

Figure 6:
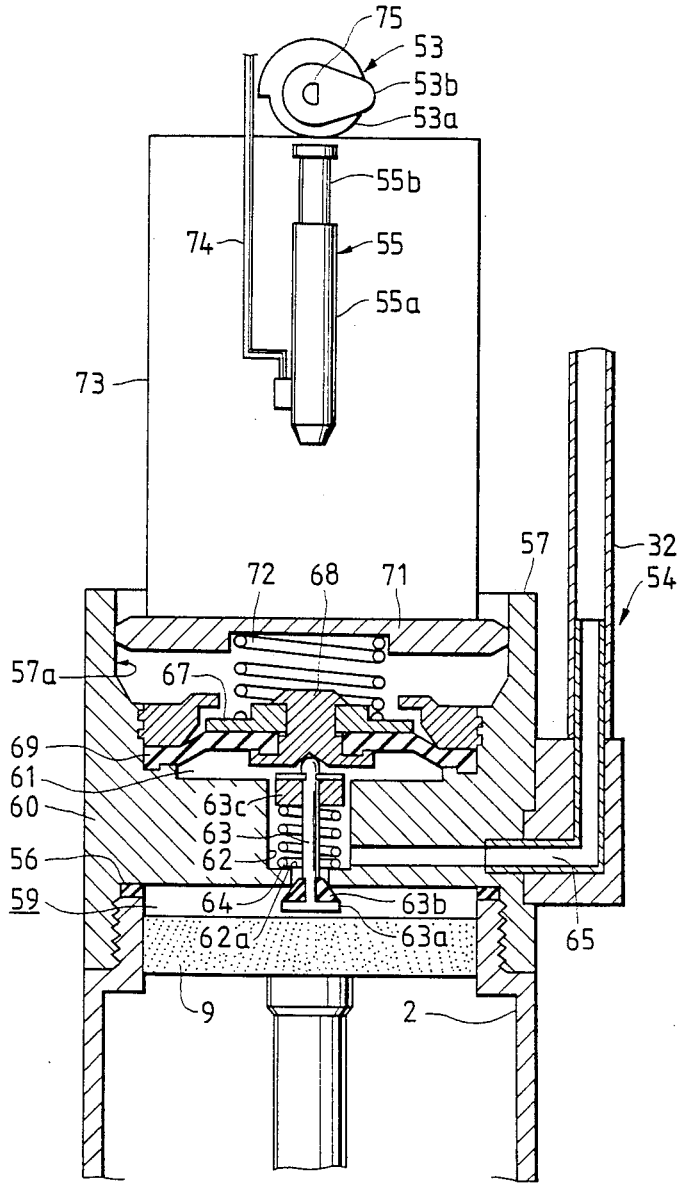
FIGS. 6 and 7 are partially cross-sectional views showing a regulator, a piezoelectric element ignition unit, and a cam switch used in the second embodiment.
Figure 7:
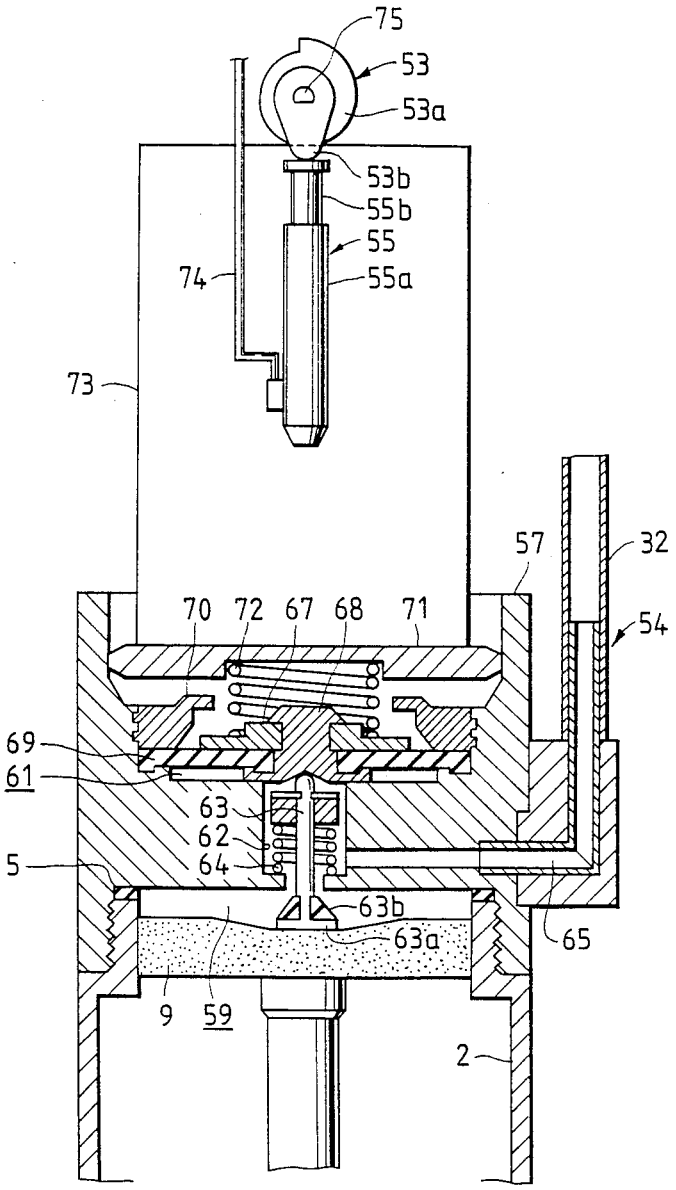

The regulator mechanism 54 is constructed as follows:

As shown in FIGS. 6 and 7, the upper open end of the gas reservoir 2 is sealingly secured with a valve support member 57 through a sealing member 56. The support member 57 defines a first chamber 59 in its lower section which communicates with the interior of the gas reservoir 2 through sponge material 9 and a second chamber 61 in its upper section isolated from the first chamber by a partition wall 60. Both these chambers 59 and 61 communicate with each other through a communicating passage 62 formed in the wall 60. Positioned in the passage 62 is a valve member 63 which is vertically movable. The lower end of the valve member 63 is formed with a valve head 63*a* having an increased cross-sectional area. The valve head 63*a* is provided with a sealing member 63*b* adapted to be in contact with the lower opening of the communicating passage 62. The valve member 63 is biased upwardly by a spring 64 which is interposed between a spring seat 63*c* fixed at the upper section of the valve member 63 and a stepped section 62*a* formed in the communicating passage 62. By this biasing force, the sealing member 63*b* always closes the communicating passage 62. The passage 62 also communicates with a gas flow passage 65 connected to the gas conduit 32.

The second chamber 61 is defined by the upper surface of the wall 60 and a diaghragm 69. The diaphragm 69 is made of rubber and has a circumferential portion annularly supported by a fitting member 70. The diaphragm 69 is integrally formed with a pressure receiving plate 67 and a core member 68. The second chamber 61 is sealingly isolated from the upper recessed space 57*a* of the support member 57 by this diaphragm 69 and the core member 68. This space 57*a* houses an adjusting plate 71 vertically movable therein, and a spring 72 is provided for receiving the plate 71. The adjusting plate 71 is integrally fixed to the bottom of the connection plate 73.

The piezoelectric ignition device 55 includes a main body 55*a* containing a piezoelectric element (not shown), and a hammer switch 55*b* slidably set with respect to the main body 55*a* and biased upwardly by a spring (not shown). As the hammer switch 55*b* is depressed against the biasing force of the spring and is released, it is quickly returned by the spring force and hits the piezoelectric element, to thereby provide an electrical spark. The body 55*a* is fixed on the main case body 1 and further provided with a lead wire 74 through which the generated electric energy is led to a mixing pipe described later.

Figure 5:
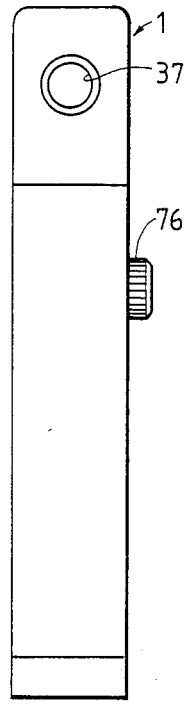
FIG. 5 is a right side view of FIG. 4.

The cam switch 53 is rotatably supported on the main case body 1 through a pivot shaft 75 as shown in FIG. 6. One end of the shaft 75 is protruded out of the main case body 1 and is fixed with a knob 76 as shown in FIG. 5. This cam switch 53 is integrally fixed with a large cam 53*a* for actuating the regulator mechanism 54 and a small cam 53*b* for actuating the piezoelectric ignition device 55. The large cam 53*a* depresses the connection plate 73 and the small cam 53*b* depresses the hammer switch 55*b*, respectively.

On one side of the heat conductive pipe 23', an oxidizing catalytic unit 24' is mounted in parallel therewith, and a gas injection pipe 25' is arranged in the hollow space of the catalytic unit 24'. The gas injection pipe 25' is connected to a mixing pipe 31 which communicates with a gas conduit 32 conncted to the regulator mechanism 54.

The oxidizing catalytic unit 24' is covered with a heat retaining metal cylinder 27' and thus the heat surrounding the catalytic unit 24' is effectively transmitted to the heat conductive pipe 23' through the metal cylinder 27'.

Figure 4:
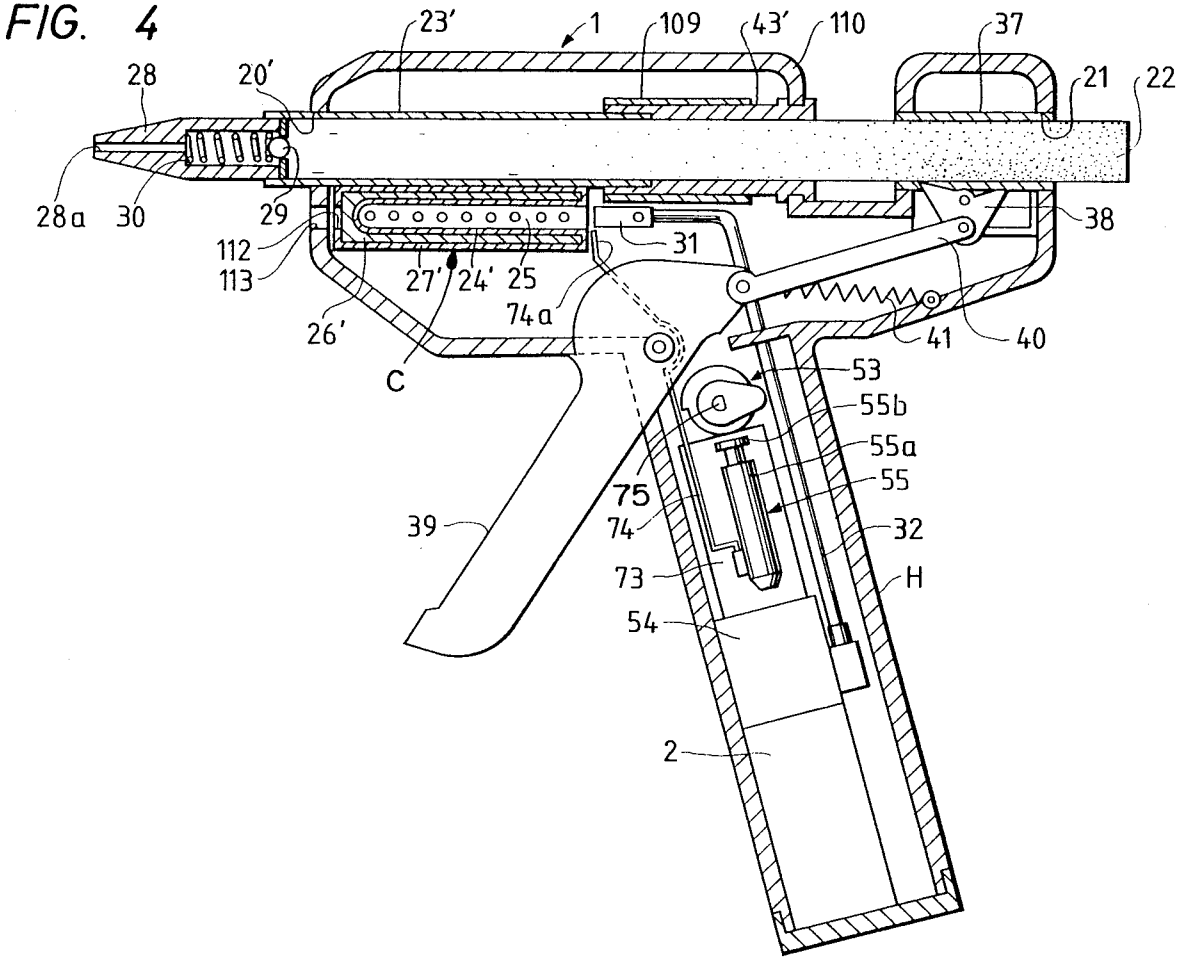
FIG. 4 is a vertical cross-sectional side view showing an overall arrangement of an adhesive discharger according to a second embodiment of this invention.

Although FIG. 4 shows an example wherein the oxidizing catalytic unit 24' is juxtaposed with the heat conductive pipe 23', are other arrangements are possible, for example, wherein one oxidizing catalytic unit 24' is arranged around the heat conductive pipe 23' and another oxidizing catalytic unit is arranged around the gas injection pipe 25', and the metal cylinder 27' wholly covers the two catalytic units.

In this embodiment, one end 74*a* of the lead wire 74 is disposed adjacent the mixing pipe 31 and the gas injection pipe 25'. The heat conductive pipe 23' is partially covered with a bush 43' and a metal tube 109. The bush 43' is fitted with an opening 110 formed in the main case body 1 so that the heat conductive pipe 23' is supported by the case body 1. The bush 43' is preferably made of polytetrafluoroethylene for example having sufficient heat resistivity and non-tackiness in order to allow the adhesive stick to be smoothly inserted therethrough into the heat conductive pipe 23'.

In the second embodiment, a catalytic combustion unit C' is disposed below and in parallel with the heat conductive pipe 23' as shown in FIG. 4. Its forward end (at left side in FIG. 4) is formed with a combustion gas exhaust passage 112 which is aligned with an exhaust opening 113 formed in the front face of the main case body 1 and is directed in parallel with the discharge nozzle 28.

This catalytic combustion unit C' includes a first oxidizing catalyst 24' cylindrically mounted on the mixed gas injection pipe 25' or a mesh cylinder or coil spring (not shown), and a second oxidizing catalyst 26' provided over the first catalyst 24'. The second catalyst 26' is further covered with the heat retaining metal cylinder 27' which is fixed to the heat conductive pipe 32'. With this construction, the combustion heat generated around the catalysts 24' and 26' is transmitted to the heat conductive pipe 23' through the metal cylinder 27'. Also in this embodiment, the exhaust passage 112 is formed in the fornt end of the metal cylinder 27'.

Figure 8A:
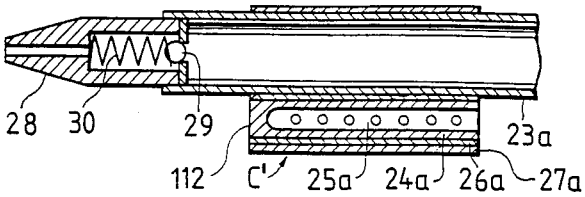
FIGS. 8(*a*) and 8(*b*) are vertical and transverse cross-sectional views showing a modified catalytic heating unit of the second embodiment.
Figure 8B:
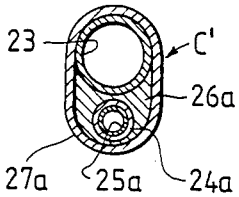
Figure 9A:
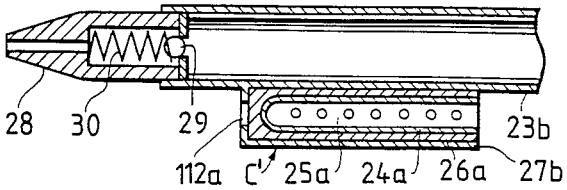
FIGS. 9(*a*) and 9(*b*) are vertical and transverse cross-sectional views showing another modification of the catalytic heating unit of the second embodiment.
Figure 9B:
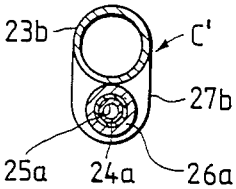

The catalytic combustion unit C' may be modified as shown in FIGS. 8 and 9.

One modified embodiment shown in FIGS. 8(*a*) and 8(*b*) includes a gas injection pipe 25*a* covered with the first oxidizing catalyst 24*a* and the second oxidizing catalyst 26*a*, and a metal cylinder 27*a* covering the second oxidizing catalyst 26*a* and a heat conductive pipe 23*a*. The combustion heat from the catalysts 24*a* and 26*a* is directly transmitted to the heat conductive pipe 23*a* through the metal cylinder 27*a*. In this modification, the front open end of the metal cylinder 27*a* serves as the combustion exhaust gas passage 112.

Another modified embodiment shown in FIGS. 9(*a*) and 9(*b*) includes a metal cylinder 27*b* integrally formed with a heat conductive pipe 23*b*. Both the first and second catalysts 24*a* and 26*a* are concentrically mounted on the gas injection pipe 25*a*, and are inserted in the metal cylinder 27*b* from its open rear end. The combustion heat is transmitted in the same manner as in the first modification. In this structure, a combustion exhaust gas passage 112*a* is formed in the front end hole formed in the metal cylinder 27*b*.

The first and second oxidizing cayalysts are of a hollow cylindrical shape. Also a crossed structure, honeycomb shaped structure or a foaming material may be used as the catalysts other than those used in the first embodiment described above.

Next, an operation of the adhesive discharger according to the second embodiment will be described.

In the state shown in FIG. 7, when the cam switch 53 is rotated about the shaft 75 in a clockwise direction, the large cam 53*a* depresses the adjusting plate 71 through the connection plate 73. Then the pressure receiving plate 67 and the core member 68 are depressed by the force through the spring 72, and the valve member 63 is moved downwardly against the biasing force of the spring 64. The sealing member 63*b* of the valve top 63*a* is moved away from the lower end of the communicating passage 62, so that the gasified fuel passed through the sponge member 9 flows into the second chamber 61 through the first chamber 59. When the fuel gas pressure in the second chamber 61 reaches a predetermined level, the diaphragm plate 69 is subjected to the gas pressure, and the pressure receiving plate 67 and the core member 68 are lifted upwardly. Therefore, the valve member 63 is moved upwardly, and is returned to its regular position by the biasing force of the spring 64 so that the sealing member 63*b* closes the lower end of the communicating passage 62. As a result, the fuel gas is stopped flowing from the first chamber 59 to the second chamber 61.

The gas reserved in the second chamber 61 and the communicating passage 62 is fed into the gas conduit 32 through the gas flow passage 65. This feeding work decreases the inner pressure of the second chamber 61, and thus the pressure receiving plate 67 and the core member 68 are returned to their primary positions. The valve member 63 is also moved downwardly and the communicating passage 62 is opened again. The gas in the first chamber 59 flows towards the second chamber 61.

The above mentioned operation is repeatedly carried out to cause the fuel gas to flow at a constant rate from the first chamber 59 to the gas conduit 32 through the communication passage 62, the second chamber 61 and the gas flow passage 65.

The fuel gas flowed through the conduit 32 is then fed into the mixing pipe 31 and mixed with air taken in through an air inlet (not shown). The mixed gas is dispersed to the oxidizing catalyst 24' from the gas injection pipe 25'.

On the other hand, the hammer switch 55*b* of the piezoelectric ignition device 55 is depressed by the small cam 53*b* concurrently with the gas supplying operation. The ignition device 55 produces an electrical spark at the top terminal 74*a* of the lead wire 74 which end 74*a* is positioned adjacent the mixing pipe 31. Therefore, the gas is ignited. The dispersed gas also starts catalytic combustion. This combustion heat leads to melting of the adhesive stick 22 previously inserted in the heat conductive pipe 23'. Upon of the trigger 39, the succeeding adhesive stick inserted in the feeding member 37 is fed into the heat conductive pipe 23' by driving the clamp arm 38. The melted adhesive 22 is pressed forwards and discharged through the discharging nozzle.

As the trigger 39 is released, it returns to its original position by means of the spring 41 and the feeding member 37 also returns to its original position similar to the first embodiment.

The combustion exhaust gas generated in the catalytic combustion unit C' is exhausted out of the main case body 1 through the exhaust passage 112 and the exhaust opening 113. In this case, the heat retaining sleeve 27' prevents the exhaust gas from spreading radially outwardly, but most of the exhaust gas is discharged toward the discharging nozzle 28.

Figure 10:
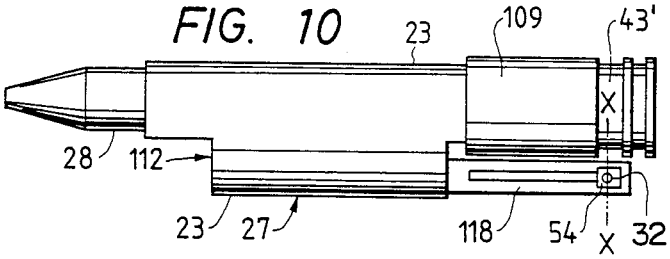
FIG. 10 is a front view showing a modified gas flow regulator.
Figure 11:
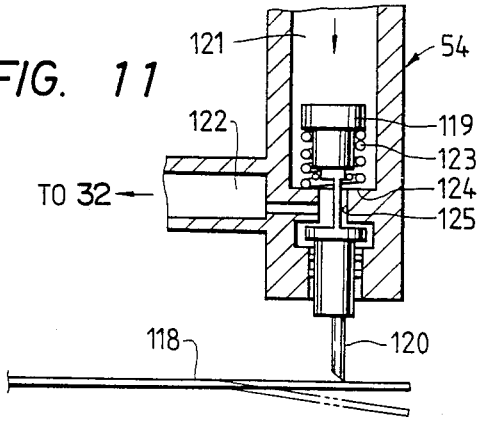
FIG. 11 is an enlarged cross-sectional view taken along the line X—X in FIG. 10.

Referring to FIGS. 10 and 11, there is shown another modified example of the gas supply unit or gas flow regulator.

One end of a bimetal 118 is secured to a heat conductive pipe 23 so that the bimetal 118 is kept in parallel with the pipe 23 at a normal temperature such as room temperature, and the bimetal 118 holds a reset rod 120 of a valve member 119 at its ascent position. This is the open position of the valve member 119. Fuel gas is supplied from a gas inlet passage 121 in fluid communication with, the gas reservoir 2 to a gas outlet passage 122 which communicates with a gas conduit 32 which is connected to the mixing pipe 31 as described above.

As the temperature of the heat conductive pipe 23 is elevated due to the catalytic combustion, the bimetal 118 is bent downwardly as represented by a phantom line in FIG. 11, and the reset rod 120 is moved to its descent position by the biasing force of the spring 123. The valve member 119 is also moved downwardly by the spring 123 and is brought into seating contact with a valve seat 124 and thus closes a valve opening 125. As a result, gas flow is cut-off.

The valve member 119 continuously repeats open and close operations at approximately a predetermined temperature. The gas flow at a predetermined amount is fed to the mixing pipe 31 and ignited by the above-described ignition unit to maintain the heat conductive pipe 23 at the predetermined temperature.

As explained above, the adhesive discharger according to the present invention includes the fuel gas flow regulator 3 connected to the gas reservoir 2 in addition to the adhesive melting mechanism wherein the fuel gas is dispersed in the oxidizing catalysts 24 and 26 and its catalytic combustion is generated to melt the adhesive stick 22 inserted in the melting pipe 23, and the melted adhesive is discharged through the discharge nozzle 28. The gas flow regulator 3 detects the temperature of the heat conductive pipe 23 and the conducted heat through the thermo-conductive pipe 18, and regulates the fuel gas flow by actuating the gas flow adjusting member 9 controlled by the bimetal 17. This regulator 3 can effect the stabilization of gas flow rate and automatic control for the catalytic combustion temperature. Thus, the discharger can provide several advantages such that the melting condution for the adhesive stick is stabilized, the melted degree of the adhesive stick is properly adjusted to facilitate discharge of the adhesive through the nozzle 28, the combustion temperature is easily controllable to fit with ambient temperature; i.e., summer or winter, indoor or outdoor, and the like. Further, the discharger can be produced in a compact size with simple structure at low cost, since the regulator 3 is mounted on the gas reservoir 2.

The adhesive discharger according to the second embodiment provides further advantages by synchronous operation of the gas flow regulator 54 in the gas supply unit and the piezoelectric element ignition device 55 of the ignition unit by the cam switch 53. In other words, the fuel gas injection and the ignition are synchronously controlled, which prevents fuel gas from over-flowing or leaking without being ignited. This can ensure safe operation during service and reduce the running cost. Additionally, these gas injection and ignition operations can be easily and stably performed by a single action of the cam switch 53. This structure can also reduce the number of mechanical parts and the weight, thereby resulting in a low manufacturing cost in addition to easy handling.

Furthermore, the adhesive discharger of this invention prevents the combustion exhaust gas from spreading radially outwardly relative to the metal cylinder 27 which covers the catalytic combustion space. The exhaust gas is linearly discharged through the exhaust passage 112 in a direction along the adhesive discharge nozzle 28. This structure can improve the heat conductivity for the heat conductive pipe 23 and provides safe operation of the discharger. Moreover, the exhaust gas discharged from the exhaust passage 112 can be directed toward the surface to be discharged or toward the discharged melted adhesive, and therefore, heat of the exhaust gas can be utilized for heating these surfaces.

While the invention has been described in detail kand with reference to specific embodiments thereof, it will be apparent form those skilled in the art that various changes and modifications can be made therein without departing form the spirit and scope of the invention.

What is claimed is:

1. A gun-type portable adhesive discharger comprising a main case body for supporting a rigid adhesive stick extending in a longitudinal direction of said main case body, a hand grip portion for holding said main case body, a heating unit disposed in said main case body for melting said adhesive stick, said heating unit comprising a catalytic combustion unit disposed in said main case body and at a position adjacent said rigid adhesive stick, a nozzle portion connected to a front end of said main body for discharging said adhesive stick melted by said heating unit, and, a trigger portion disposed at said hand grip portion and connected to said adhesive stick for feeding said adhesive stick toward said nozzle portion, said main case body and said hand grip portion providing an interior space therein;

a gas supply unit having a gas reservoir disposed in said hand grip portion for storing catalytically combustable substance therein and, an ignition unit for igniting said catalytically combustible substance, said ignition unit being disposed in said interior space, said gas supply unit comprising a gas flow regulating unit disposed in said interior space and positioned above said gas reservoir for supplying controlled amounts of said combustible substance to said catalytic combustion unit, said gas flow regulating unit comprising a support member disposed at an open end of said gas reservoir, said support member being formed with a stepped recess;

a valve member slidably disposed in said stepped recess for selectively allowing said cumbustible substance to pass therethrough;

a gas nozzle slidably disposed in said valve member, and being biased toward a bottom of said stepped recess, an upper end of said gas nozzle being connected to said catalytic combustion unit;

a gas flow controlling member disposed over said support member and threadingly engaged with said gas reservoir for changing an interior volume defined by said support member and said gas flow controlling member;

a bimetal disposed between said gas flow controlling member and an upper portion of said valve member;

a heat conductive member having one end connected to said catalytic combustion unit and another end connected to said bimetal for deforming said bimetal in response to a temperature of said catalytic combustion unit; said valve member being slidable in response to deformation of said bimetal.

2. The adhesive discharger of claim 1, further comprising a gas flow adjusting member interposed between said bottom of said stepped recess and a bottom of said valve member.

3. The adhesive discharger of claim 2, further comprising a manual switch connected to said gas nozzle for forcibly moving said gas nozzle away from said bottom of said valve member, to thereby supply said combustible substance toward said catalytic combustion unit.

4. The adhesive discharger of claim 1, wherein said ignition unit comprises a heating element positioned beside said catalytic combustion unit a battery packed in said hand grip portion, and an ignition switch connected to said heating element and said battery.

5. The adhesive discharger of claim 1, further comprising a heat transmission pipe extending in said main case body for allowing said adhesive stick to pass therethrough, said heat transmission pipe being in contact with said catalytic combustion unit.

6. The adhesive discharger of claim 5, wherein said catalytic combustion unit comprises:

a gas injection member connected to said gas flow regulating unit said gas injection member extending parallel to said heat transmission pipe;

first and second catalysts provided over said gas injection member; and a heat retaining pipe disposed over said first and second catalysts, said heat retaining pipe extending in a direction parallel with said gas injection member.

7. The adhesive discharger of claim 6, wherein said gas injection member is formed of metal, and a plurality of injection holes are formed at a wall portion of said gas injection member for allowing said combustible substance to pass therethrough.

8. The adhesive discharger of claim 6, wherein said gas injection member comprises a cylindrical mesh member.

9. The adhesive discharger of claim 6, wherein said gas injection member comprises a coil spring.

10. The adhesive discharger of claim 6, wherein said heat retaining pipe is disposed over said first and second catalysts and said gas injection member.

11. The adhesive discharger of claim 6, wherein said heat retaining pipe has an outer peripheral wall in contact with said heat transmission pipe.

12. The adhesive discharger of claim 1, wherein said catalytic combustion unit is formed with a cumbustion exhaust gas passage at a front end portion of said catalytic combustion unit for linearly discharging said exhaust gas in a direction parallel with said nozzle portion.

13. A gun-type portable adhsesive discharger comprising a main case body for supporting a rigid adhesive stick extending in a longitudinal direction of said main case body, a hand grip portion for holding said main case body, a heating unit disposed in said main case body for melting said adhesive stick, said heating unit comprising a catalytic combustion unit disposed in said main case body and at a position adjacent said rigid adhesive stick, a nozzle portion connected to a front end of said main body for discharging said adhesive stick melted by said heating unit, and, a trigger portion disposed at said hand grip portion and connected to said adhesive stick for feeding said adhesive stick toward said nozzle portion, said main case body and said hand grip portion providing an interior space therein, a gas supply unit having a gas reservoir disposed in said hand grip portion for storing catalytically cumbustible substance therein, and an ignition unit for igniting said catalytically combustible substance, said ignition unit being disposed in said interior space, said gas supply unit comprising a gas flow regulating unit disposed in said interior space and positioned above said gas reservoir for supplying controlled amounts of said combustible substance to said catalytic combustion unit, said gas flow regulating unit comprising:

a valve support member having an upper hollow open end portion and a lower wall, said lower wall being formed with a central recess, said central recess being in fluid communication with said catalytic combustion unit;

a valve member slidably disposed in said central recess;

a pressure adjusting plate slidably disposed with respect to said upper hollow open end portion;

a diaphragm member disposed between said pressure adjusting plate and said lower wall for urging said valve member; and, a gas flow adjusting member disposed at an open end of said gas reservoir, said lower wall and said gas flow adjusting member defining a first chamber therebetween, said lower wall and said diaphragm member defining a second chamber therebetween; said first and second chambers being selectively communicable with each other upon sliding movement of said valve member.

14. The adhesive discharger of claim 13, wherein said ignition unit comprises a piezoelectric ignition means disposed in said hand grip portion, and a spark portion positioned adjacent to said catalytic combustion unit, said spark portion being electrically connected to said piezoelectric ingition means.

15. The adhesive discharger of claim 14, further comprising actuation means disposed in said hand grip portion for simultaneously actuating said ignition unit and said gas flow regulating unit.

16. The adhesive discharger of claim 15, wherein said actuation means comprises: a connection plate having one end connected to said pressure adjusting plate, a first cam in camming contact with another end of said connection plate, and a second cam in camming contact with said piezoelectric ignition means, said first and second cams being rotatable about a common axis.

17. The adhesive discharger of claim 13, wherein said gas flow regulating unit supplies a controlled amount of said combustible substance in response to a pressure on said gas flow regulating unit.

18. A gun-type portable adhesive discharger comprising:

a main case body for supporting a rigid adhesive stick extending in a longitudinal direction of said main case body, said main case body having an exhaust opening, a hand grip portion for holding said main case body, a heating unit disposed in said main case body for melting said adhesive stick, said heating unit comprising a catalytic combustion unit disposed in said main case body and at a position adjacent said rigid adhesive stick, a nozzle portion connected to a front end of said main body for discharging said adhesive stick melted by said heating unit, a trigger portion disposed at said hand grip portion and connected to said adhesive stick for feeding said adhesive stick toward said nozzle portion, said main case body and said hand grip portion providing an interior space therein, a gas supply unit having a gas reservoir disposed in said hand grip portion for storing catalytically combustible substance therein, said gas supply unit comprising a gas flow regulating unit disposed in said interior space positioned above said gas reservoir for supplying controlled amounts of said combustible substance to a mixing pipe in which said combustible substance is mixed with air and then supplied to said catalytic combustion unit, an ignition unit for igniting said catalytically combustible substance, said ignition unit being disposed in said interior space, a heat transmission pipe extending in said main case body for allowing said adhesive stick to pass therethrough, said heat transmission pipe being in contact with said catalytic combustion unit, said catalytic combustion unit comprising a gas injection member connected to said gas flow regulating unit, said gas injection member extending parallel to said heat transmission pipe, first and second catalysts provided over said gas injection member, and a heat retaining pipe disposed over said first and second catalysts, said heat retaining pipe extending in a direction parallel with said gas injection member, said catalytic combustion unit having a combustion exhaust gas passage formed at a front end portion thereof, said combustion exhaust gas passage and said exhaust opening being substantially coaxial with said gas injection member and said heat retaining pipe for linearly discharging said exhaust gas in a direction parallel with said nozzle portion, said mixing pipe being positioned opposite said exhaust gas passage with respect to said gas injection member and said heat retaining pipe.

* * * * *